United States Patent [19]

Kishel

[11] 4,333,068

[45] Jun. 1, 1982

[54] POSITION TRANSDUCER

[75] Inventor: Joseph F. Kishel, Clarks Summit, Pa.

[73] Assignee: Sangamo Weston, Inc., Norcross, Ga.

[21] Appl. No.: 172,902

[22] Filed: Jul. 28, 1980

[51] Int. Cl.[3] ..... H01C 10/28

[52] U.S. Cl. ..... 338/158; 338/154; 338/202; 338/184

[58] Field of Search ..... 338/154, 157, 158, 69, 338/79, 89, 85, 114, 167, 164, 188, 184, 202

[56] References Cited

U.S. PATENT DOCUMENTS

| | | | |
|---|---|---|---|
| 1,793,090 | 2/1931 | Hite | 338/154 |
| 2,000,177 | 5/1935 | Kenney | 338/157 X |
| 2,000,178 | 5/1935 | Kenney | 338/157 X |
| 2,315,277 | 3/1943 | Shaw | 338/157 |
| 2,454,278 | 11/1948 | Gordy | 338/154 |
| 2,575,230 | 11/1951 | Mork | 338/154 |
| 2,862,088 | 11/1958 | Mairs | 338/154 |
| 2,862,089 | 11/1958 | Mairs | 338/154 |
| 2,909,748 | 10/1959 | Emery et al. | 338/158 |
| 2,914,744 | 11/1959 | Schendel | 338/164 |
| 2,917,720 | 12/1959 | Budd et al. | 338/154 |
| 3,102,989 | 9/1963 | Sielsch | 338/154 |
| 3,123,793 | 3/1964 | Flygstad et al. | 338/154 |
| 3,151,307 | 9/1964 | Mairs | 338/158 |
| 3,624,583 | 11/1971 | Nakada | 338/69 |
| 3,626,350 | 12/1971 | Suzuki et al. | 338/69 |
| 3,764,953 | 10/1973 | Lehnert | 338/154 |
| 3,772,629 | 11/1973 | Meylan-Rochat | 338/154 |

*Primary Examiner*—C. L. Albritton
*Attorney, Agent, or Firm*—Dale Gaudier

[57] ABSTRACT

A sealed position transducer which is self-wiping and which is readily adaptable for providing both linear and nonlinear electrical outputs. The transducer includes a housing, a resistive element received in the housing, and a flexible membrane, having a conductive portion formed thereon facing the resistive element, disposed over the resistive element and attached to the housing to seal the interior of the housing from the environment. An object whose position is to be sensed or measured is mounted on or connected to a carriage which movably engages a guide track formed as part of the housing. The carriage includes a roller which causes the conductive portion of the membrane to be deflected into contact with a portion of the resistive element.

In one embodiment, where a linear relationship between resistance and distance is desired, a resistive element having a known, constant resistance per unit length is used. By measuring the resistance between the point of contact of the membrane and the resistive element, the distance of the roller from one end of the resistive element is readily determined. Where a nonlinear relationship is desired, a pressure contact clip is used to compress the conductive portion of the flexible membrane into contact with a selected portion of the resistive element.

16 Claims, 12 Drawing Figures

FIG. 4
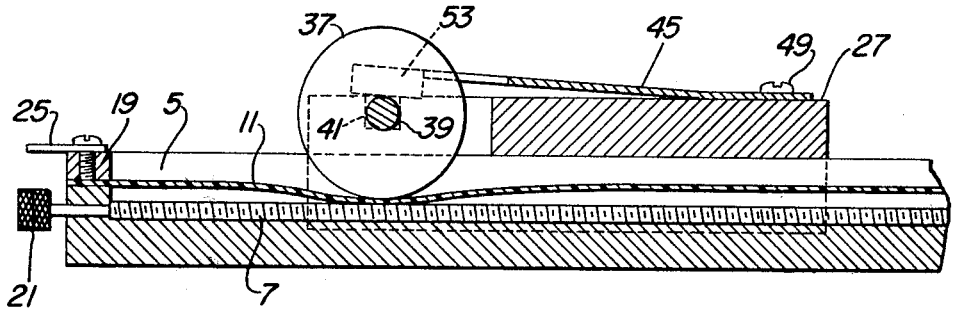
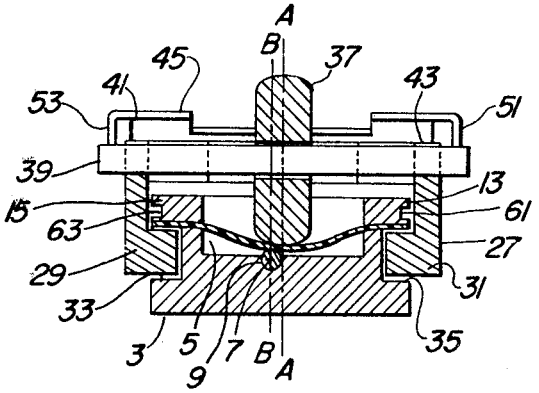
FIG. 5
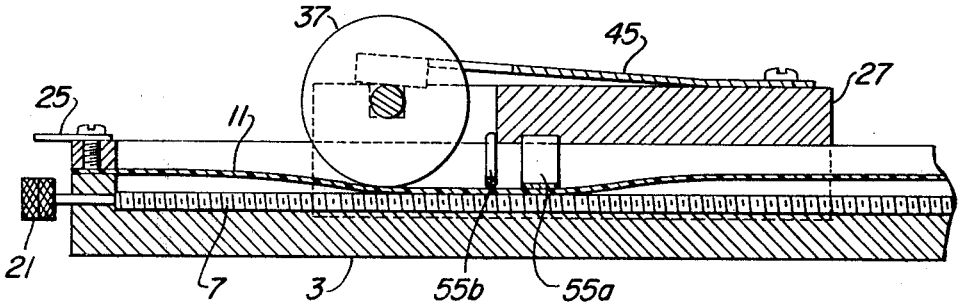
FIG. 6

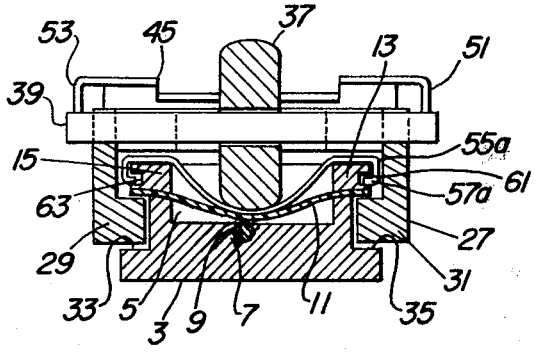
FIG. 7
FIG. 8a
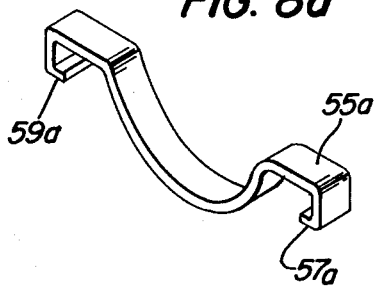
FIG. 8b
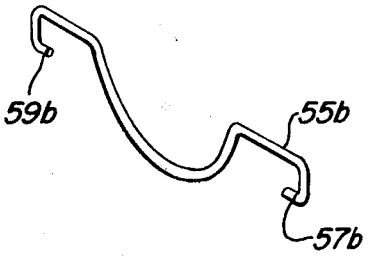
FIG. 11
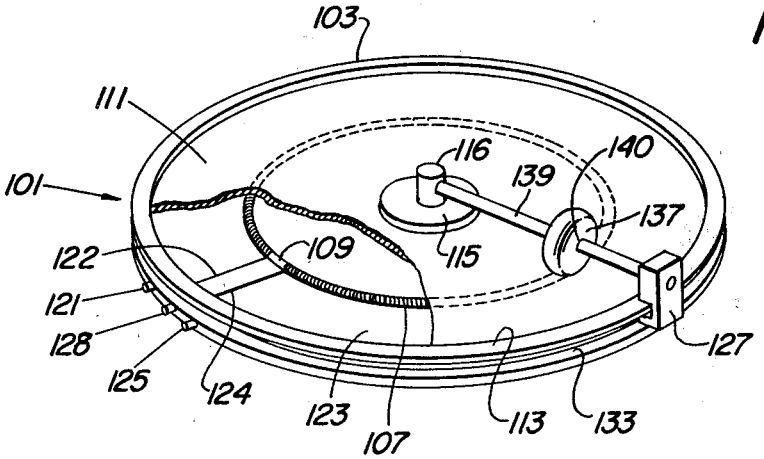

POSITION TRANSDUCER

FIELD OF THE INVENTION

The invention relates to the field of position transducers and more particularly to a position transducer which can produce both linear and nonlinear outputs.

BACKGROUND OF THE INVENTION

Prior art position transducers have taken many forms. One common type of transducer utilizes a flat or wirewound resistive element upon which a conductive slider or roller bears. Assuming the resistance per unit length of resistive element is known, by measuring the resistance between the slider or roller and the resistive element the position of the slider or roller along the resistive element with respect to one end of the element can be readily calculated.

However, such an arrangement has several disadvantages. Such transducers generally are not sealed, resulting in the accumulation of dirt and the formation of oxides on the resistive element which affects the contact resistance between the roller or slider and the resistive element. The build up of oxides and dirt causes inaccuracies in the resistance measured resulting in an inaccurate determination of position for an object coupled to the slider or roller. Further, a slider or roller directly in contact with the resistive element produces a high contact resistance resulting in further inaccuracies in the resistance measurement. While a certain amount of frictional contact between the roller or slider and the resistive element is beneficial in cleaning or "wiping" oxides and dirt disposed on the resistive element, too high a pressure, combined with direct contact of the roller or slider with the resistive element causes wearing of the outer surface of the resistive element leading to a shorter life for the element.

It is often desirable to measure the position or motion of an object which moves in a nonlinear manner, e.g. reciprocating motion, or to compensate for nonlinearities in a system. However, prior art position transducers are generally incapable of readily providing a nonlinear output relationship. In addition, it is often desirable to have a transducer which provides a selectable degree of positional resolution along selected portions of the transducer.

SUMMARY OF THE INVENTION

These and other disadvantages of prior art position transducers are overcome by the present invention wherein there is provided a transducer comprising a housing, a resistive element disposed in the housing, a flexible membrane disposed over the resistive element and including a conductive portion facing the resistive element, and means, such as a pressure roller, for engaging the flexible membrane so as to cause the conductive portion of the membrane to be deflected into contact with the resistive element at a point directly adjacent the pressure roller. The pressure roller can be mounted to a carriage which is movable with respect to the housing. Preferably, the pressure roller is arranged such that its plane of rotation is offset from a plane which includes the longitudinal axis of the resistive element so as to provide a beneficial wiping action between the conductive portion of the membrane and the surface of the resistive element.

In the preferred embodiment the flexible membrane completely seals the portion of the housing containing the resistive element from the environment. The flexible membrane can be a thin sheet of conductive material, such a beryllium copper, or a thin sheet of dielectric material, such as Mylar ®, having a conductive coating applied to the portion of the sheet facing the resistive element. The resistive element, for example, is a linear wirewound resistor of circular cross section.

Electrical connections are made with the conductive portion of the membrane and the resistive element. Since the resistance per unit length of the resistive element is known, by measuring the resistance between the point where the roller causes the conductive portion of the membrane to be deflected into contact with the resistive element, the distance of the roller, or an object connected to or mounted on the carriage, from one end of the resistive element is readily determined.

Alternatively, where a nonlinear relationship between resistance and distance is desired, one or more pressure contact clips are used to compress the conductive portion of the flexible membrane into contact with one or more selected portions of the resistive element. By varying the point of contact of the clip with the flexible membrane, any one of a variety of nonlinear resistance vs. position relationships can be produced.

The transducer of the present invention has the advantage of being completely sealed from the environment thus eliminating the problem of dust contamination of the resistive element associated with many prior art transducers. If desired, oxide formation can be almost totally eliminated by filling the membrane covered portion of the housing with an inert dielectric gas or fluid. Exemplary fluids are silicon grease, silicon fluids, sulfur hexafluoride, and Capella-B oil. Further, the arrangement of the present invention provides a beneficial wiping action between the conductive portion of the membrane and the resistive element to ensure positive and reliable electrical contact therebetween. The transducer uses a minimum of parts and there are no internal moving parts, resulting in a device which is both highly reliable and which can be manufactured inexpensively. A further advantage is that a transducer of practically any length or configuration can be manufactured having a linear or nonlinear output, as desired.

BRIEF DESCRIPTION OF THE DRAWING FIGURES

These and other advantages and features of the present invention will be apparent from the following detailed description of the invention when taken in conjunction with the accompanying drawing figures wherein:

FIG. 4 is a sectional view of the transducer of FIG. 2 taken along lines 4—4;

FIG. 5 is a sectional view of the transducer of FIG. 3 taken along lines 5—5;

FIG. 6 is a sectional view similar to that of FIG. 5 showing a pressure contact clip used with the transducer of the present invention;

FIG. 7 is a partial side view of the transducer and pressure contact clip assembly shown in FIG. 6;

FIGS. 8A and 8B illustrate two types of pressure contact clips useful with the transducer of the present invention;

FIG. 11 is a partially broken-away perspective view of an alternate embodiment of the present invention.

DETAILED DESCRIPTION OF THE PREFERRED EMBODIMENTS

Figure 1:
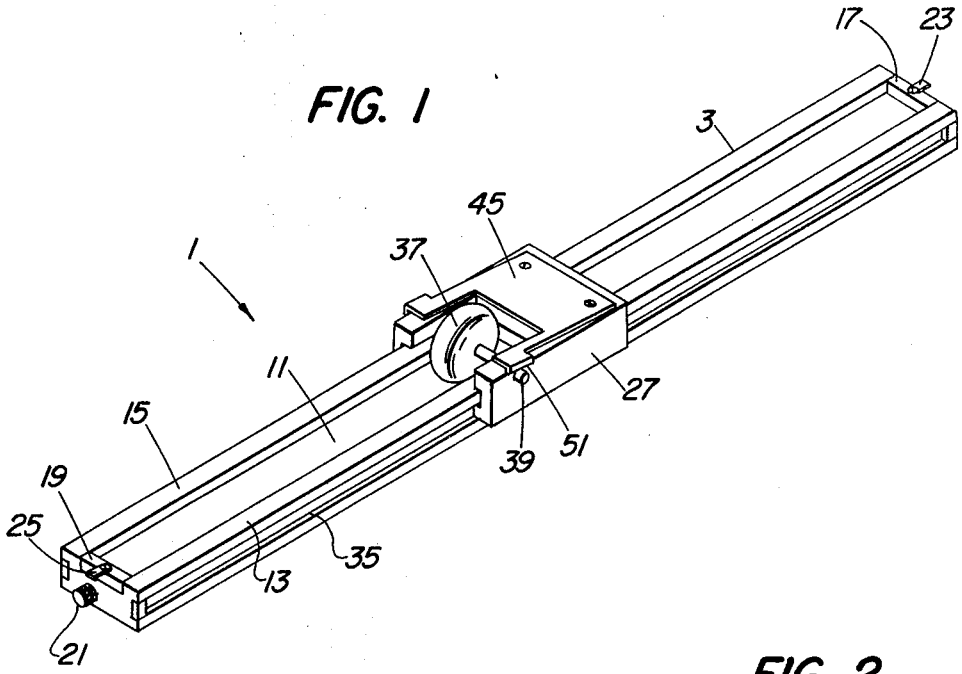
FIG. 1 is a perspective view of a transducer constructed according to the present invention.
Figure 2:
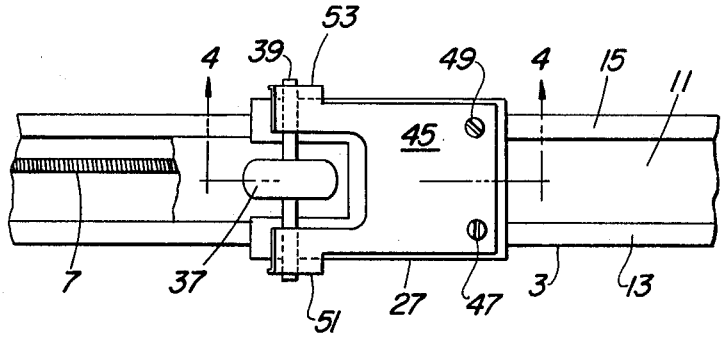
FIG. 2 is a top detail view of the transducer of FIG. 1.
Figure 3:
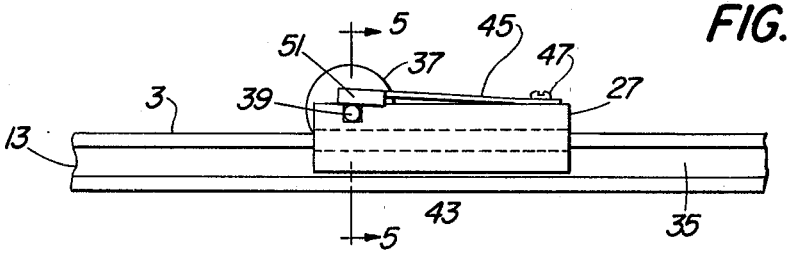
FIG. 3 is a right side detail view of the transducer shown in FIG. 1.

With reference to FIGS. 1-6 transducer 1 comprises a housing 3 having a longitudinal cavity or recess 5 formed along the length thereof. Although housing 3 is shown as being linear in form in FIG. 1, other housing configurations (such as that shown in FIG. 11) are within the purview of the present invention. A resistive element 7 is disposed along the base of cavity 5 as shown in FIG. 4. Element 7 is a wirewound resistor having a curved surface (and preferably having a substantially circular cross section, although non-circular, curved cross-sections will perform adequately), and is arranged with its longitudinal axis substantially parallel with the longitudinal axis of cavity 5. Resistive element 7 can be mounted on the base of cavity 5 by a variety of means, for example adhesive bonding. To ensure positive and accurate positioning of element 7 within cavity 5, a semi-circular groove 9, of diameter equal to or slightly greater than that of element 7, is formed in the base of cavity 5 and receives element 7. It will be appreciated that if housing 3 is formed from an electrically conductive material, such as aluminum or steel, an insulative material or coating will be applied to the base of cavity 5 and groove 9 to electrically insulate the windings of element 7 from contact with housing 3. Alternatively, resistive element 7 can be coated with an insulative coating along the portion of the element which would contact groove 9 or cavity 5. It will be appreciated that other types of resistive elements, such as those formed from a paste-like coating of resistive material, can also be used. The resistive element should have, but does not require, a curved surface to derive the benefits of self-wiping inherent in the present invention.

Disposed over cavity 5 is a flexible membrane 11. Membrane 11 completely covers cavity 5 and is sealed thereover by flanges 13 and 15 and end blocks 17 and 19. Flanges 13, 15 and blocks 17, 19 are secured to housing 3 by suitable fastening means such as adhesive bonding, welding, screws or bolts (not shown). As is apparent from FIGS. 4 and 5, membrane 11 is disposed in a spaced-apart, normally non-contacting relationship with respect to element 7. Membrane 11 preferably is a thin sheet of conductive material, such as beryllium copper. To further enhance the electrical characteristics of membrane 11 all or a portion of the side facing element 7 can be overcoated with a coating of a highly conductive material such as gold, silver, pure copper, or the like. Alternatively, membrane 11 can be a thin sheet of flexible dielectric material, such as Mylar. When a dielectric sheet is used for membrane 11 the side facing resistive element 7 would have a coating or layer of electrically conductive material provided thereon. The conductive material can cover the entire side of the dielectric sheet facing element 7 or can cover only the portion of the dielectric sheet directly opposite element 7.

Housing 3 includes terminals 21 and 23 which are electrically connected to the ends of resistive element 7. A terminal 25 is also provided which is electrically connected to the conductive portion of membrane 11. Terminals 21, 23 and 25 enable a measurement of the resistance between a point of contact of membrane 11 and one or both ends of element 7 to be readily made, as is more fully explained below.

A carriage 27 is movably mounted to and in engagement with housing 3. It can be seen from FIG. 5 that carriage 27 has a roughly "C" or "U" shaped cross section with arms 29 and 31 of carriage 27 slidably engaging respective left and right guides or recesses 33 and 35 formed by flanges 13 and 15 and housing 3. The interface between carriage arms 29 and 31 and guides 33 and 35 may be provided with suitable antifriction means, such as Teflon sheets, a solid lubricant, roller or slide bearings, or the like, so that carriage 27 is capable of smooth translatory motion along the length of housing 3.

Carriage 27 further includes a roller 37 rotatably mounted about an axle 39, with axle 39 being received in slots 41 and 43 formed in carriage 27. Roller 37 preferably is formed from a self-lubricating dielectric material such as nylon, or the like. The dimensions of roller 37 are not especially critical, with its radius having to be only sufficient to reach from axle 39 to a point substantially adjacent the outer surface of resistive element 7.

A blade or leaf spring 45 is attached to carriage 27 by bolts 47 and 49, or other fastening means, and includes ears or flaps 51 and 53 which bear upon and apply pressure to roller axle 39. Spring 45 is formed from spring steel, or the like, and is designed to apply pressure to roller axle 39 in the range of ½ to 10 lbs., depending on the degree of flexibility of the material chosen for membrane 11. Of course, there is no requirement that spring 45 be unitary, so that two springs could be used, each bearing upon respective ends of axle 39. Indeed, many types of pressure producing mechanisms could be used in conjunction with roller 37, aside from the simple leaf spring arrangment shown in the drawing figures.

An important feature of the present invention is that roller 37 and resistive element 7 are arranged with respect to one another such that the plane of rotation of roller 37 (A—A in FIG. 5) is offset from a plane which includes the longitudinal axis of resistive element 7 (B—B in FIG. 5). Preferably, both planes A—A and B—B are parallel to one another are are disposed substantially normal to the base of cavity 5 or roller axle 39. This slight offset of the plane of rotation of roller 37 and the longitudinal axis of resistive element 7 has been found to produce a beneficial cleaning or "wiping" action due to tangential movement of the conductive portion of membrane 11 with respect to the curved surface of element 7 when it is deflected into contact with element 7 by roller 37. Optimum results have been found to occur when the amount of offset is such that the plane of rotation A—A of roller 37 is substantially tangent to the outer surface of resistive element 7, as shown in FIG. 5.

In operation, an object whose position is to be measured (not shown) is connected by suitable means (such as a pushrod or arm) to carriage 27 or, alternatively, connected directly to roller 37. The object also can be mounted on or attached directly to the carriage. Of course, in some instances it may be that it will be the position of the carriage itself along housing 3 which is to be measured. Spring 45 applies pressure to axle 39 causing roller 37 to deflect membrane 11 toward resistive element 7 in the region near roller 37. The conductive portion of membrane 11 contacts the surface of resistive element 7 at a point directly below the center of axle 39, touching one or more turns thereof, depending on the relative sizes of element 7, roller 37, the thickness and stiffness of membrane 11, and the pressure applied by spring 45 to roller 37. Optimumly, only one or two turns are contacted, since this will result in the most accurate determination of the distance of the center of axle 39 from one end of housing 3.

Since the resistance per unit length (Ω/1) for resistive element 7 is a known constant, the position of axle 39, and hence carriage 27, can be readily determined by measuring the resistance between one or the other end of resistive element 7 and the conductive portion of membrane 11 (via terminals 21 or 23 and 25) and dividing this amount by the known resistance per unit length. Alternatively, terminals 23 and 25 can be connected together and the resistance measurement is then taken between these terminals and terminal 21. Such measurements can be made automatically by converting the analog resistance measurement into a digital signal through the use of an analog to digital converter, performing the arithmetic manipulations required to calculate the positional information (through the use of a programmable microprocessor or other arithmetic manipulation unit), and applying the resulting signal indicative of the distance of the roller axle 39 from one end of housing 3 to a digital display. The use of a programmable microprocessor to perform the aforesaid functions has inherent advantages in that any non-linearity of the resistive element, such as that due to temperature, can be compensated for, along with the capability of generating an internal distance offset, such as when it is desired to measure the position of an object which is not in line with the axis of roller axle 39. In addition to calculating the position of the carriage or an object connected thereto, it can be seen that the microprocessor in combination with suitable timing means can also be used to calculate the speed or acceleration of the carriage or object.

While the above-described arrangement results in a transducer having a linear relationship between resistance and distance, in some applications it is desirable to have a transducer whose output is nonlinear. As shown in FIGS. 6–8 the transducer of the present invention is readily adapted to produce a nonlinear output through the provision of pressure contact clips 55*a* or 55*b*, shown respectively in FIGS. 8*a* and 8*b*. The clips are similar, with clips 55*a* and 55*b* having respective pairs of arms 57*a*, 59*a* and 57*b*, 59*b* formed thereon, the respective clip arms being adapted to engage recesses 61 and 63 formed on flanges 13 and 15 of housing 3. The central portion of either clip 55*a* or 55*b* is bent in shallow "U" shape. The clips can be formed from a variety of materials, such as spring steel or beryllium copper. The clip can have some width, such as clip 55*a* shown in FIG. 8*a*, with a width of no more than ¼ the diameter of roller 37 being preferred for good resolution. Alternatively, the clip can be formed from resilent wire, or the like, such as clip 55*b* shown in FIG. 8*b*. When attached to rails 13 and 15, clip 55*a* or 55*b* causes a portion of membrane 11 to be deflected into contact with one or more windings of resistive element 7.

Figure 9:
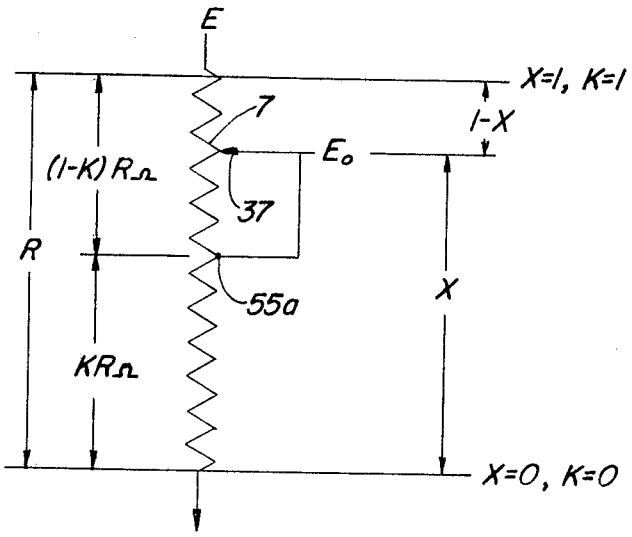
FIG. 9 is a schematic diagram illustrating the electrical characteristics of the present invention when used as a nonlinear position transducer.

FIG. 9 shows a schematic equivalent of the transducer used with such a pressure contact clip placed at some position "K" where K can have a value between 0 and 1. The unloaded output voltage measured at the conductive membrane relative to ground can be expressed as a function of X (the fraction of carriage travel) as follows:

$$Eo = E\left[\frac{K}{K+1-X}\right] \text{ From } X = K \text{ to } X = 1 \quad (1)$$

$$Eo = E\left[\frac{X}{X+1-K}\right] \text{ From } X = O \text{ to } X = K \quad (2)$$

Figure 10:
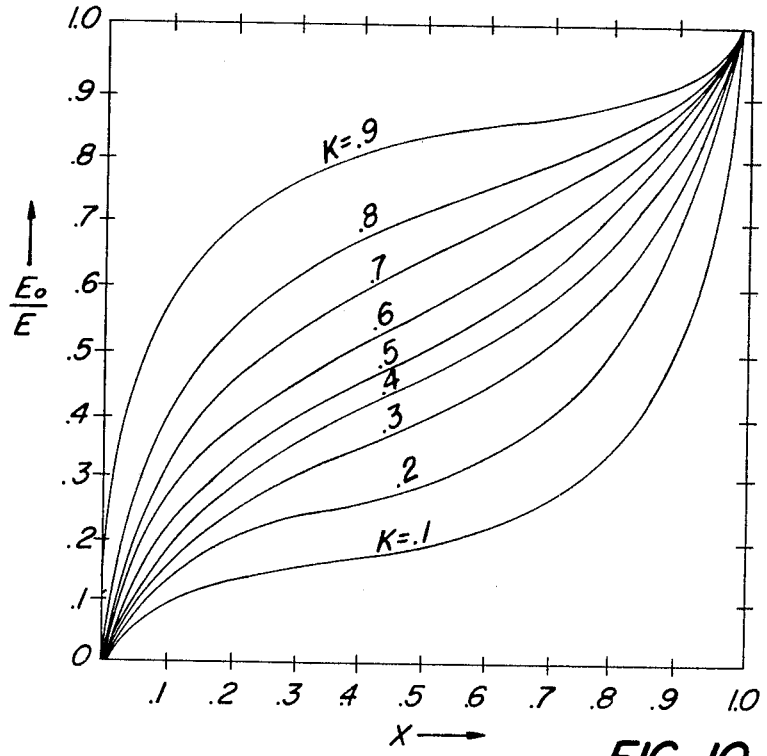
FIG. 10 is a graph of a variety of nonlinear relationships which can be produced by the transducer represented in FIG. 9.

This pair of equations was used to generate the family of curves shown in FIG. 10. A very wide range of functional relationships can be generated with a single contact clip and fine adjustments to the function desired can be made by simply moving the point of contact slightly. Positional resolution can also be varied by placement of the clip since the volts per unit distance (FIG. 10) varies as a function of the placement of the clip. The addition of a second clip will result in a constant voltage output when roller 37 is in the zone between the clips.

Although the invention has been described with reference to a separate housing having guides for the carriage, it is understood that the housing can be formed integral with the walls, floor, housing, etc., of an object. Indeed, there is no absolute requirement that the housing or guide means be linear in form, and circular or other forms are within the scope of the invention, with suitable modifications to the carriage.

One such alternative embodiment is shown in FIG. 11. A circular sealed transducer 101 comprises a housing 103 having a base 123 and a resistive element 107 disposed on the base of the transducer. The resistive element is preferably arranged concentric with a guide track 133 formed as part of the outer perimeter of housing 103. Preferably, resistive element 107 is affixed within a semicircular groove 109 formed in base 123. Opposite ends of resistive element 107 are electrically connected to terminals 121 and 123 via leads 122 and 124, respectively.

A thin circular membrane or diaphram 111 is disposed over base 128 in a manner such that the membrane does not normally contact the surface of resistive element 107. As in the embodiment of FIGS. 1–7 the membrane is formed from a thin sheet of conductive or dielectric material. If a dielectric material is used, a portion of the side of membrane 111 which faces resistive element 107 will have a conductive material applied thereto. An electrical connection is made from the conductive portion of membrane 111 to terminal 125.

Membrane 111 seals the resistive element within housing 103 in a manner analogous to that shown in FIGS. 1–7. Flange 113 of housing 103 is attached to base 123 to seal the outer perimeter of the membrane to the housing. The inner, annular portion of membrane 111 is sealed to base 123 by means of circular flange 115.

Flange 115 further includes a pivot assembly 116 to which one end of shaft 139 is mounted. The other end of shaft 139 is mounted in carriage 127. Carriage 127 includes a portion which movably engages guide track 133 of housing 103. A pressure roller 137 is rotatably mounted on shaft 139 at a point substantially adjacent to resistive element 107. Preferably roller 137 is arranged such that its plane of rotation is substantially tangent to the outer surface of element 107. Roller 137 is held in position along shaft 139 by a pair of retaining rings 140 (only one shown in FIG. 11).

It can be seen that the operation of the embodiment of FIG. 11 is analogous to that described above with respect to FIGS. 1–7. As carriage 127 moves along track 133, roller 137 contacts membrane 111 causing it to be deflected into contact with a portion of resistive element 107. Where the length to diameter ratio of shaft 139 is sufficiently large, the inherent springiness of the shaft can be used to bias roller 137 into contact with membrane 111 and resistive element 107. In other situations it may be desirable to provide other biasing means for roller 137 or shaft 139 to ensure sufficient contact pressure between membrane 111 and resistive element 107. Electrical sensing of the position of carriage 127, or an object connected thereto, is made through terminals 121, 128 and 125. One or more pressure contact clips analogous to those described with respect to FIGS. 6–8 can also be used with the embodiment of FIG. 11 to provide a nonlinear output.

Alternatively, in place of the axle and roller combination of FIG. 11 a pressure arm and captured ball bearing could be used. In this arrangement one end of the pressure arm is attached to pivot assembly 116 with the free end including a cup or other such means for retaining a ball bearing or the like. The springiness of the pressure arm causes the ball bearing to deflect the membrane into contact with the resistive element. Such an arrangement is especially useful where transducer 101 is to be used as a potentiometer.

Although the invention has been described with respect to a single resistive element and pressure roller per transducer housing, it is understood that the present invention contemplates appropriately modified arrangements where more than one resistive element, pressure roller, or carriage is used with each transducer housing. Indeed, it can be seen that there is no strict requirement that there be a separate carriage and pressure roller combination provided for deflecting the flexible membrane into contact with a resistive element. All that is required is some means which contacts the membrane to cause it to be deflected into contact with a portion of a resistive element.

While the present invention has been described in considerable detail, it is understood that various changes and modifications are within the spirit and scope of the present invention as defined by the appended claims.

What is claimed is:

1. A sealed transducer comprising:

(a) housing;

(b) at least one resistive element having a curved surface disposed in said housing;

(c) a flexible membrane disposed in a non-contacting relationship with each said resistive element, said flexible membrane having a conductive portion facing each said resistive element;

(d) means for sealing said flexible membrane to said housing;

(e) means for making respective electrical connections with said flexible membrane and each said resistive element; and (f) means, movable with respect to and engaging said flexible membrane, for engaging said flexible membrane to cause said conductive portion of said membrane to contact each said resistive element, said means including at least one roller means, each said roller means having its plane of rotation offset from a plane which includes the longitudinal axis of each said resistive element whereby a wiping action is produced between said conductive portion of said flexible membrane and the surface of each said resistive element.

2. A sealed transducer comprising:

(a) a linear housing having a longitudinal cavity formed therein;

(b) at least one linear resistive element having a curved surface disposed in said cavity, each said element having its longitudinal axis disposed substantially parallel to the longitudinal axis of said cavity;

(c) a flexible membrane covering said cavity in a noncontacting relationship with respect to each said resistive element, said membrane being conductive along at least on a portion of the surface facing said resistive element;

(d) means for sealing said flexible membrane over said cavity;

(e) means for making respective electrical connections with said conductive portion of said flexible membrane and each said resistive element; and (f) carriage means, movable with respect to and engaging a guide track formed as part of said housing, said carriage means including at least one pressure roller for engaging said flexible membrane and causing the conductive portion of said membrane to directly contact the curved surface of a resistive element, each said roller being rotatably connected to said carriage means such that the plane of rotation of each said roller is aligned substantially tangent to the curved surface of a resistive element, whereby a wiping action is provided between said conductive portion of said membrane and the curved surface of a resistive element.

3. A sealed transducer comprising:

(a) a circular housing having an annular cavity formed therein;

(b) at least one linear resistive element having a curved surface disposed in said cavity, each said element having its longitudinal axis concentric with said annular cavity;

(c) a flexible membrane covering said cavity in a non-contacting relationship with respect to each said resistive element, said membrane being conductive along at least on a portion of the surface facing each said resistive element;

(d) means for sealing said flexible membrane over said cavity;

(e) means for making respective electrical connections with said conductive portion of said flexible membrane and each said resistive element; and (f) carriage means, movable with respect to and engaging a guide track formed as part of said housing, said carriage means including at least one pressure roller for engaging said flexible membrane and causing the conductive portion of said membrane to directly contact the curved surface of a resistive element, each said roller being rotatably connected to said carriage means such that the plane of rotation of each said roller is aligned substantially tangent to the curved surface of a resistive element, whereby a wiping action is provided between said conductive portion of said membrane and the curved surface of a resistive element.

4. The transducer of claim 1 wherein said housing is linear in form and includes at least one longitudinal groove formed along a portion of the base thereof for receiving a resistive element.

5. The transducer of claim 1 wherein said housing is circular in form and includes at least one annular groove formed along a substantial portion of the base thereof for receiving a resistive element.

6. The transducer of claim 1 wherein each said resistive element is a wirewound resistor.

7. The transducer of claim 1 wherein said flexible membrane comprises a thin sheet of conductive metal.

8. The transducer of claim 7 wherein at least a portion of said membrane facing each said resistive element is coated with a highly conductive material.

9. The transducer of claim 1 wherein said flexible membrane comprises a thin sheet of dielectric material having at least a portion facing each said resistive element coated with a conductive material.

10. The transducer of claim 1 wherein each said roller means is mounted such that said plane of rotation of each said roller means is tangent to the outer surface of a resistive element.

11. The transducer of claim 1 wherein each said roller means is a pressure roller rotatably mounted about an axle connected to a carriage means, said carriage means being movable with respect to and engaging guide means formed as part of said housing.

12. The transducer of claim 11 wherein said carriage means includes means for applying pressure to each said roller axle to cause each said roller to bear against and deform said flexible membrane.

13. The transducer of claim 12 wherein said means for applying pressure to each said roller axle comprises at least one leaf spring attached to said carriage means.

14. The transducer of claim 1 further including at least one pressure contact clip for causing said flexible membrane to contact at least one of said resistive elements, whereby a nonlinear electrical relationship is produced between the ends of a resistive element and said flexible membrane.

15. The transducer of either claim 2 or claim 3 further including at least one pressure contact clip for causing said flexible membrane to contact at least one of said resistive elements, whereby a nonlinear electrical relationship is produced between the ends of a resistive element and said flexible membrane.

16. The transducer of any one of claims 1, 2 or 3 wherein said sealed housing includes an inert fluid.

* * * * *

UNITED STATES PATENT AND TRADEMARK OFFICE

CERTIFICATE OF CORRECTION

PATENT NO. : 4,333,068

DATED : June 1, 1982

INVENTOR(S) : Joseph F. Kishel

It is certified that error appears in the above-identified patent and that said Letters Patent are hereby corrected as shown below:

Column 2, line 3, "a beryllium" should read -- as beryllium --.

Column 4, line 50, "are are" should read -- and are --.

Column 6, line 47, "123" should read -- 128 --.

Column 6, line 50, "128" should read -- 123 --.

In the Claims:

Claim 2, column 8, line 21, "noncontacting" should read -- non-contacting --.

Claim 2, column 8, line 24, insert -- each -- between "facing" and "said".

Signed and Sealed this

Seventh Day of September 1982

[SEAL]

Attest:

GERALD J. MOSSINGHOFF

Attesting Officer

Commissioner of Patents and Trademarks